United States Patent [19]

Stockton et al.

[11] Patent Number: 4,676,137

[45] Date of Patent: Jun. 30, 1987

[54] WEAPON FIREARM WITH MAGAZINE

[75] Inventors: Warren D. Stockton; Michael K. Miller, both of Bakersfield, Calif.

[73] Assignee: Kern Instrument & Tooling, Inc., Bakersfield, Calif.

[21] Appl. No.: 736,071

[22] Filed: May 20, 1985

[51] Int. Cl.[4] ..... F41C 25/10

[52] U.S. Cl. ..... 89/33.02

[58] Field of Search ..... 89/33.02; 42/19, 17

[56] References Cited

U.S. PATENT DOCUMENTS

| | | | |
|---|---|---|---|
| 84,685 | 12/1868 | Evans | 42/49.01 |
| 1,285,263 | 11/1918 | Lohne | 89/33.02 X |
| 1,293,396 | 2/1919 | Fox | 89/33.02 X |
| 2,619,876 | 12/1952 | Olson | 89/33 |
| 3,088,378 | 5/1963 | Boudreau | 89/33.02 X |
| 3,427,923 | 2/1969 | Meyer et al. | 89/33 |
| 3,747,249 | 7/1973 | Ouellette | 42/50 |
| 3,766,823 | 10/1973 | Folsom et al. | 89/33 D |
| 4,166,408 | 9/1979 | Wetzel et al. | 89/33 D |
| 4,207,797 | 6/1980 | Györik | 89/34 |
| 4,332,097 | 6/1982 | Taylor, Jr. | 42/50 |
| 4,487,103 | 12/1984 | Atchisson | 89/33.02 |

*Primary Examiner*—John F. Terapane
*Assistant Examiner*—John S. Maples
*Attorney, Agent, or Firm*—Roylance, Abrams, Berdo & Goodman

[57] ABSTRACT

The disclosure relates to firearms, especially recoil or gas operated firearms, having a receiver for cartridges, and having a magazine for containing a plurality of cartridges. The magazine can be disposed above and substantially parallel with respect to the barrel. The magazine includes a housing with a helically disposed member providing a helical passageway for the cartridges. The cartridges are supported on a cartridge carrier located in the housing, which can be rotated by a torque spring. The cartridges are unloaded from the magazine by a feed lip insert providing communication with the receiver of the firearm.

7 Claims, 4 Drawing Figures

WEAPON FIREARM WITH MAGAZINE

BACKGROUND OF THE INVENTION (1) Field of the Invention

This invention may be classified in Class 49 and appropriate sub-classes.

The present invention is concerned with an improved firearm and, more particularly, relates to a firearm or similar weapon with a magazine which is adapted to contain or house a large number of rounds or cartridges.

Still more particularly, the invention relates to a firearm, e.g. a recoil or gas operated firearm, constructed in such a manner that it can receive and accept cartridges stored in and delivered from the magazine according to our invention.

(2) Prior Art

Warren Evans patented a repeating rifle in 1868, wherein the butt-stock houses an ammunition carrier in the form of an Archimedian screw, which ammunition carrier has a capacity of 26 cartridges. The breech mechanism would be operated by an under-lever which also rotates the carrier, with the pitch of the screw being such so as to deliver one cartridge for each stroke of the lever. The primary disadvantage of the weapon of Evans is the slow and cumbersome process of loading the ammunition carrier. Only upon being fully loaded and rotated by 26 strokes of the operating lever is the first round delivered to the breech.

The prior art also includes U.S. Pat. No. 1,285,263 issued Nov. 19, 1918, to Lohne. The patent of Lohne is concerned with a magazine including a cylindrical container into the wall of which is formed a continuous groove which serves to guide a helical screw-type feeder, and a slide or driver is adapted to progress along the path of the respective screw for moving the cartridges forward.

U.S. Pat. No. 1,353,092 issued Sept. 14, 1920, to Thompson et al relates to a cartridge magazine of the rotary type combining with its functions as a magazine that of lubricating the ammunition which it contains.

U.S. Pat. No. 2,619,876 issued Dec. 2, 1952, to Olson discloses a magazine rifle in which a magazine is fixed beneath and disposed longitudinally of the barrel. The cartridges are located in groups in the magazine and are presented in groups and by way of spring pressure, into the receiver. The cartridges are then individually moved into the path of the breech bolt so that the latter may force successive cartridges into the firing chamber.

The more recent U.S. Pat. No. 4,166,408, issued Sept. 4, 1979, of Wetzel et al, is concerned with an ammunition handling system for storing and for feeding ammunition at high velocity which is embodied in a system for storing and feeding linkless rounds of ammunition to a high rate of fire machine gun, as in a pod externally mounted to an aircraft.

In conventional firearms it is also a detriment with respect to magazines that protrude perpendicularly downward from the firearm because this mounting attitude tends to cause undesirable interference and imbalances.

There has continued to remain, accordingly, the need to provide an improved firearm, for example a recoil or gas operated or similar weapon, and a magazine therefore which are adapted to preclude disadvantages of the prior art firearms and magazines.

SUMMARY OF THE INVENTION

A primary aspect of our invention is that the magazine is positioned atop the firearm so that the longitudinal central axis of the magazine extends parallel with respect to the longitudinal central axis of the receiver and/or the barrel of the firearm. Accordingly, use can be made of gravity in the transfer of cartridges from the magazine to the firing mechanism of the firearm.

The magazine of our invention consists of a longitudinal cylindrical outer shell, or similar housing, which is equipped with an interior helically disposed rib member. Accordingly, a substantially continuous, helical passageway is formed in and over substantially the full length of the housing by the flights of the rib member.

It is preferred that the helical rib member is disposed in such a way that its lead is equal to its width plus the length of the cartridge, and that its height is approximately one-half of the diameter of a respective cartridge.

To complement the helical passageway, the magazine also includes a generally cylindrical cartridge carrier or similar driver having longitudinal ridges and grooves in its outer surface for aligned retention of the cartridges. The ridges and grooves give a flute-like appearance to the carrier or driver, and such flutes can be either straight, i.e. parallel with respect to the longitudinal central axis of the driver, or alternatively they can also be helically disposed on the outer circumferential wall of the driver. The respective cartridges are disposed in aligned manner in the grooves of the driver.

The cartridge carrier has a longitudinal central passage for arranging therein a spring for the provision of motive power to the cartridge carrier and consequently the cartridges arranged thereon in the grooves. It is preferred that the drive spring be a torque spring.

Thus, the cartridge carrier or driver can be rotated within the housing and the cartridges positioned in the grooves are then advanced or pushed forward along the helical passageway by way of the flights of the helical rib member.

A feed ramp, or feed lip insert or similar element, is arranged at the exit terminus of the housing. Accordingly, when the first cartridge encounters this terminus, it is taken out of the helical passageway and is passed through an opening in the housing or outer magazine shell to lodge it in the feed lip insert and in proper position for the firearm bolt which will push it forward into the firing chamber. As one cartridge is removed to the chamber of the firearm, the cartridge carrier is allowed to rotate again, due to the spring being temporarily slightly released when a cartridge is transferred to the firearm, and the next cartridge is advanced.

The helical torque spring arranged within the cartridge carrier is fixed at one end thereof to the cartridge carrier and the other end is attached to an end cap of the housing. The end cap can be manually rotated to load or tension the spring, and is prevented from slipping back by a ratchet formation at the end of the housing. The end cap can be manually disengaged to allow cartridges to be loaded into the magazine prior to tensioning the torque spring.

It is also preferred that the magazine is placed above the firearm receiver. This is beneficial because the mass of the magazine and the contained cartridges will help to counteract the tendency of the firearm's muzzle to rise after each slot.

The firearm includes means to accept the magazine, to orient the magazine, to secure the magazine, and to release the magazine, for example when it is empty.

Thus, the forearm has an opening at the top of the receiver to allow insertion of the feed lip arrangement of the magazine. The firearm also includes detents and mechanisms to correctly orient and grasp the magazine. The firearm otherwise allows customary firing of the cartridges or rounds emanating from the magazine.

Included in the objects of our invention are:

To provide a firearm and a magazine therefor which can be easily and quickly utilized by a user.

To provide a firearm and magazine therefor which are balanced for more accurate firing of the firearm.

To provide a firearm which is of minimum frontal area and overall size for use in a confined space.

To provide a magazine which is widely applicable to various firearms and calibers, including semi-automatic handguns, rifles, carbines, and shotguns.

SPECIFIC DESCRIPTION

Figure 1:
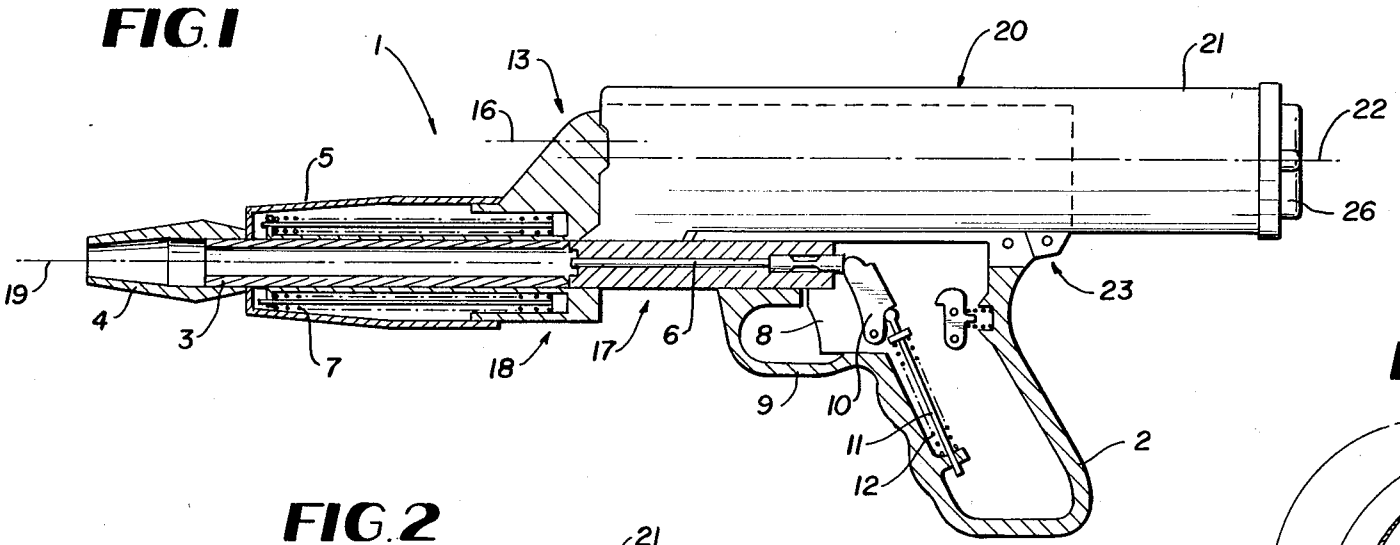
FIG. 1 is a side elevation showing a pistol with the cartridge magazine in accordance with one embodiment of the invention.

In the drawing like reference characters designate like elements in the various views of the drawings.

In this specification and the following claims the directional indications are with respect to the firearm, thus "forwardly" and the like terminology means in the direction of the discharge of the firearm and "rearwardly" and the like expressions indicate the opposite direction.

As suggested in FIG. 1, the firearm 1, is exemplified by a hand-held pistol, say a recoil or gas operated unit. The firearm 1 has a handle or grip 2 and a barrel 3 secured forwardly of the handle 2. A flash suppressor 4 is mounted on the forward end of the barrel 3. A bolt guide cover 5 surrounds the barrel 3 and a bolt pin 6 with its respective bolt pin spring 7. The firearm 1 includes a trigger 8 protected by a trigger guard 9, and the trigger 8 is adapted to actuate a hammer 10 by way of the associated hammer pin 11, with a hammer pin spring 12 providing the attendant biasing force.

A receiver 13 is provided atop the barrel 3 for introducing cartridges 14 into the firearm 1. The receiver 13 has a receiver opening 15 (see FIG. 4) adapted in its size to that of the cartridges 14, as well as having a respective axis 16. As is customary in firearms of this type, the cartridges 14 can be serially introduced into a breech 17 which is connected to the firing chamber 18 for firing through the action of the bolt, i.e. bolt pin 6, and associated known parts which need not be further described for an understanding of our invention.

Mounted atop the firearm 1 is a magazine assembly 20, referred to as magazine hereinafter, which contains and moves the cartridges 14 for firing from the firearm 1. The magazine 20 includes a hollow cylindrical magazine housing 21 which is releasably mounted atop the firearm 1. This mounting is such that, when the magazine 20 is in the operative position, the longitudinal central axis 22 thereof is located above and generally parallel to the respective axis 16 of the firearm receiver 13, and/or parallel to the longitudinal central axis 19 of barrel 3. Of course, the magazine 20 is then generally positioned above and parallel to the forearm of a user.

The magazine 20 is secured to the firearm 1 by means of a front socket and pin detent, shown schematically at the front of magazine 20, but not shown in detail, for holding the magazine 20 on the firearm 1, and there is also provided a spring pin detent 23 at the bottom rear of the magazine for this purpose.

Figure 4:
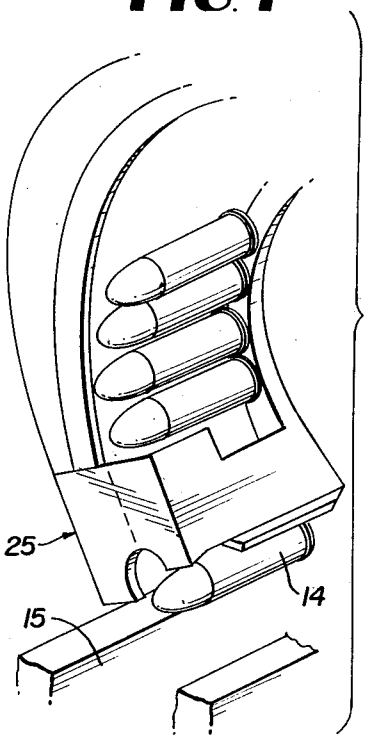
FIG. 4 is a perspective view showing the feed lip insert at the forward terminus of the magazine.
Figure 3:
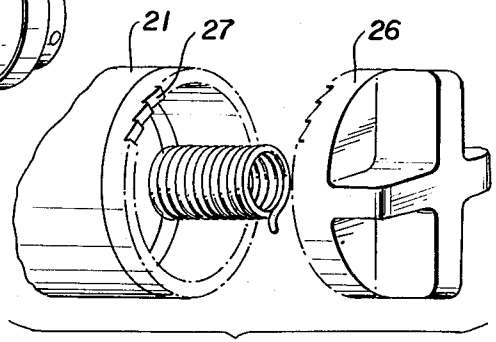
FIG. 3 is a perspective exploded view showing in greater detail the ratchet arrangement for the magazine.
Figure 2:
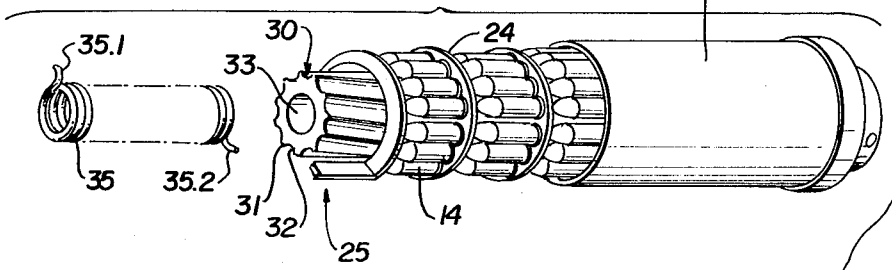
FIG. 2 is a perspective exploded view showing in greater detail the various elements of the magazine in accordance with one embodiment of the invention.

A helical member 24 is arranged on the interior wall of housing 21, and it terminates near a feed lip insert, or feed ramp arrangement, designated by reference numeral 25, see FIG. 4, at the forward terminus. The rearward end of the housing 21 is closed by an end cap or winder 26.

A ratchet wheel formation 27 is provided near the rearward end of the housing 21. The respective ratchet teeth of this formation are adapted to meshingly cooperate with corresponding teeth in the winder 26. The ratchet wheel formation 27 can be integrally molded with the housing 21.

The helical member 24 forms a continuous helical groove or a similar passageway between its helical flights. It is preferred that the helical rib member or rib 24 be disposed in the magazine housing 21 in such a way so that its lead or pitch is equal to its width plus the length of a cartridge 14, and its height is approximately half the diameter of a respective cartridge 14.

The inclined feed lip insert 25 is arranged at the forward terminus of the helical passage or contained helical path in the outer shell or housing 21, and this feed lip insert 25 will direct cartridges 14 away from a core or similar cartridge carrier 30 out of the housing 21, for presenting them in succession from above to the opening 15 of the firearm 1.

Thus, the rib member 24 leaves room for the inner and generally cylindrical cartridge carrier 30. Longitudinal upstanding ribs or ridges 31 and rounded grooves or channel formations 32 are provided on the outer surface of the cartridge carrier 30. The ridges 31 and rounded channel or groove formations 32 also extend in the longitudinal direction of axis 22. The cartridge carrier 30 has a longitudinal bore or similar central passage, i. e. a hole 33 when viewed in cross section.

The central longitudinal bore 33 serves to receive therethrough a drive spring 35 having a forward end 35.1 and a rearward end 35.2. It is preferred that the drive spring 35 be a torque spring adapted to provide turning power to the cartridge carrier 30.

Thus, the magazine 20 for the firearm 1 is comprised of an outer cylindrical shell or housing 21 having a helical member 24 affixed therein to form a helical passageway for the cartridges 14, and having a separate hollow core or cartridge carrier 30 which can be rotated inside the helical member 24 by way of torque spring 35. The cartridge carrier 30 has in its circumference longitudinally disposed grooves 32 in which the cartridges 14 are positioned and these, accordingly, can be propelled radially and longitudinally along the helical passageway formed by the helical member 24.

OPERATION

The helical torque spring 35 can be wound-up by turning the winder 26 appropriately. The spring 35 can then operate as a spring drive or motor when the stored tension is released. The spring 35 applies a radial torque to the cartridge carrier 30 and propels the cartridges 14 along the helical passageway in the housing 21 towards the feed lip insert 25 that retains the cartridges in position ready for the firearms bolt, i.e. bolt pin 6, to propel it into the firing chamber 18, upon selection of this action.

The feed lip insert 25 extends radially away from the housing 21 thereby providing a guide which enters or merges into the receiver opening 15 in the upper portion of the receiver 13. Accordingly, the cartridges 14 are aligned and oriented in the magazine well to the rear of the firearm 1. The cartridges are also appropriately held in a position directly above and parallel to the firearm's receiver 13 with the housing's feed lip insert 25 being nested within the opening 15 of the receiver 13.

The magazine 21 is readily lifted from the firearm due to the socket and pin detent in the front, and the associated spring pin detent 23 at the bottom rear of the magazine. Together these two means locate and hold the magazine 20 in the proper relationship with respect to the firearm 1 during transfer of cartridges 14 from the housing 21 to the receiver opening 15 of the firearm 1.

The helical drive or torque spring 35 is attached with its end 35.2 joined to the winder 26, but allowing turning or rotation of the winder to wind-up or tension the spring 35.

When the cartridge carrier 30 rotates within the housing 21, the cartridges 14 lying in the longitudinal grooves 32 are pushed forward or advanced by the helical member 24. At the terminus of the helical passageway, the cartridges 14 are passed through the feed lip insert 25 into the receiver opening, in proper position for the firearm bolt pin 6 to push then forward into the firing chamber 18. As one cartridge 14 is removed to the chamber 18, the cartridge carrier 30 is allowed to rotate, thus presenting the contained cartridges in succession to the firearm receiver 13. This rotation occurs because of the helical torque spring 35 arranged within the cartridge carrier The winder 26 is rotated manually to load the spring 35 and is prevented from slipping back by the ratchet formation 27 and the matching teeth of the winder 26.

In summary, an easier loading of the cartridges 14 is attained than hitherto experienced in similar firearms, with the feed lip insert 25 in the housing 21 supplying them to the opening 15.

A firearm can readily be equipped with the magazine by having an opening 15 at the top of the receiver 13 that permits insertion of the feed lip insert 25 of the magazine housing 21.

As mentioned, the preferred application of the magazine would be to place it above the firearm receiver, where the mass of the contained cartridges helps counteract the tendency of the firearm muzzle or barrel to rise after each shot. The firearm is readily equipped to accept the magazine, with respective mechanisms to orient and latch it, and to release it when it is empty.

The principles of operation are applicable to most calibers and types of existing firearms, including semi-automatic handguns, rifles, carbines, and shotguns. The magazine provides improvements in capacity, compactness, streamlining and balance over conventional vertical stack magazines.

The weapon uniquely combines high cartridge capacity within a minimum frontal area and overall size for operating within a confined space.

Reference in this disclosure to details of the specific embodiments is not intended to restrict the scope of the appended claims, which themselves recite those features regarded as essential to the invention.

We claim:

1. In combination, a firearm and cartridge magazine, said firearm comprising a receiver opening for receiving cartridges from said magazine seriatim, said magazine having an elongated generally cylindrical configuration and a longitudinal axis, means to store a relatively large number of cartridges in said magazine, said magazine comprising means forming a helical cartridge feed path therein, said cartridges being stored in said magazine with their axes generally parallel to said longitudinal axis of said magazine, said magazine comprising cartridge exit means positioned on said magazine at the front end thereof, said cartridge exit means being cooperable with said firearm receiver opening to feed said cartridges into said opening seriatim, power driving means for feeding said relatively large number of cartridges in said helical feed path through said magazine and out said exit means, said power driving means comprising a helical torque spring having sufficient strength to drive all of said relatively large number of cartridges out of said magazine, means for selectively and manually energizing said power driving means including means to permit winding of said helical spring independently of the loading and unloading of cartridges into and out of said magazine; whereby said cartridges may be loaded into said magazine with said power driving means relaxed and whereby said power driving means may be manually energized immediately prior to use of said firearm and magazine; and means to mount said magazine above said firearm with its longitudinal axis parallel to the line of fire of said firearm and with said exit means in operative cooperation with said receiver opening and with the weight of said magazine and of said relatively large number of cartridges located rearwardly of said receiver opening means in said firearm and above and in line with the line of fire of said firearm.

2. The combination of claim 1, said exit means comprising a feed lip insert, said feed lip insert being located at the forward terminus of said magazine for directing cartridges away from said magazine and including means for retaining the next cartridge to exit said magazine in a position ready for acceptance and firing by the firearm, and said feed lip insert extending away from said magazine to form a guide that enters said firearm receiver opening for orienting said magazine on said firearm.

3. The combination of claim 1, said means to removably mount said magazine on said firearm comprising socket and pin detent means at the front of said magazine and on said firearm at the location where said magazine mounts on said firearm and spring pin detent means at the bottom rear of the magazine, and said socket and pin detent means and said spring pin detent means acting together to locate and hold the magazine in a predetermined relationship to the firearm.

4. The combination of claim 1, said power driving means comprising a winder;

a cartridge carrier in said magazine; and means to mount said torque spring in said cartridge carrier, and said torque spring being adapted to be wound-up and released and when released to apply radial torque to said cartridge carrier for propelling cartridges in said grooves along said helical path.

5. The combination of claim 4, and further comprising ratchet means between said winder and said housing adapted to allow said winder to be rotated freely only in the direction for winding up said torque spring.

6. The combination of claim 1, said magazine comprising:

a longitudinal hollow housing;

a helical member arranged interiorly in said housing and affixed thereto, said member forming said helical path for said relatively large number of cartridges; and a cartridge carrier mounted in said housing for rotation inside said helical member, said cartridge carrier having cartridge receiving grooves defined by ridges along its length in which the cartridges lie for propelling the cartridges radially and longitudinally along said helical path.

7. The combination of claim 6, wherein the pitch of the helical path formed by said helical member in the magazine is equal to the length of said member measured parallel to said axis of said magazine plus the length of a cartridge, and wherein the radial height of said helical member is equal to approximately one half the diameter of a cartridge.

* * * * *